US007609240B2

(12) United States Patent
Park et al.

(10) Patent No.: US 7,609,240 B2
(45) Date of Patent: Oct. 27, 2009

(54) LIGHT GENERATING DEVICE, DISPLAY APPARATUS HAVING THE SAME AND METHOD OF DRIVING THE SAME

(75) Inventors: Mun-Soo Park, Suwon-si (KR); Jong-Hyon Park, Cheonan-si (KR); Myeong-Su Kim, Cheonan-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 71 days.

(21) Appl. No.: 12/026,778

(22) Filed: Feb. 6, 2008

(65) Prior Publication Data

US 2008/0203929 A1 Aug. 28, 2008

(30) Foreign Application Priority Data

Feb. 9, 2007 (KR) ..... 10-2007-0013999
Apr. 30, 2007 (KR) ..... 10-2007-0042050

(51) Int. Cl.
*G09G 3/36* (2006.01)

(52) U.S. Cl. ..... 345/82; 345/88; 345/89

(58) Field of Classification Search ..... 345/82, 345/83, 84, 102, 89, 88; 315/156, 158, 157, 315/159, 169.1, 169.3
See application file for complete search history.

(56) References Cited

U.S. PATENT DOCUMENTS 7,394,448 B2 * 7/2008 Park et al. ..... 345/102
2008/0062105 A1 * 3/2008 Han et al. ..... 345/90

* cited by examiner

*Primary Examiner*—David Hung Vu
(74) *Attorney, Agent, or Firm*—Innovation Counsel LLP

(57) ABSTRACT

A light generating device includes a brightness detector. The brightness detector extracts a brightness data from an image data. The light generating device compensates the uniformity of a white light whenever the image data that is greater than a reference gray scale is input through the brightness detector. Thus, the light generating device may compensate the uniformity of the white light in real time, so that a display apparatus employing the light generating device may improve a high-quality image.

20 Claims, 6 Drawing Sheets

LIGHT GENERATING DEVICE, DISPLAY APPARATUS HAVING THE SAME AND METHOD OF DRIVING THE SAME

CROSS-REFERENCE TO RELATED APPLICATION

This application relies for priorities upon Korean Patent Applications No. 10-2007-013999 filed on Feb. 9, 2007 and No. 2007-42050 filed on Apr. 30, 2007 the contents of which are herein incorporated by reference in their entirety.

BACKGROUND OF THE INVENTION

1. Field of the Invention

The present invention relates to a light generating device capable of improving light uniformity, a display apparatus having the light generating device, and a method of driving the light generating device.

2. Description of the Related Art

In general, as a backlight unit that supplies light to a display panel, a cold cathode fluorescent lamp (CCFL) and a light emitting diode (LED) are widely used.

In order to improve display quality, a display apparatus to which the LED is applied adopts various driving methods, such as a scanning-impulsive method, a sequential scanning method, a localized dimming method, etc.

However, light properties of the LED, such as color temperature, or brightness, etc., are varied according to hours of usage and the surrounding temperature. Thus, the uniformity (or white color balancing) of the white light emitted from the LED is deteriorated.

Recently, a color feedback system (CFS) using an optical sensor has been developed in order to compensate the uniformity of the white light.

The CFS controls a driving current applied to the LED based on a light amount from the entire LED array, so that the LED emits a desired light in response to the controlled driving current.

However, in order to apply the CFS to the LED backlight operated in the localized dimming method that separately controls the brightness of the display panel according to divided regions of the display panel, an optical sensor needs to be installed in each region of the display panel, so that a manufacturing cost of the display panel increases. Also, a light interference from adjacent regions needs to be prevented in order to accurately detect the light amount of each region. Accordingly, the CFS is difficult to be applied to the LED backlight operating in the localized dimming method.

SUMMARY OF THE INVENTION

The present invention provides a light generating device capable of improving light uniformity.

The present invention also provides a display apparatus having the light generating device.

The present invention also provides a method of driving the light generating device.

In one aspect of the present invention, a light generating device includes a brightness detector, a dimming signal controller, a light source driver, a light source section, and a light source compensator.

The brightness detector receives a plurality of image data from an exterior source and detects a plurality of brightness data corresponding to the image data. The brightness detector compares a plurality of gray scales corresponding to the image data with a reference gray scale and outputs an enable signal based on the compared result.

The dimming signal controller receives a compensation signal and the brightness data. The dimming signal controller outputs a first dimming signal corresponding to the brightness data and a second dimming signal obtained by compensating the first dimming signal based on the compensation signal.

The light source driver outputs a driving signal in response to either the first dimming signal or the second dimming signal from the dimming signal controller.

The light source section includes a plurality of light sources that generates a white light in response to the driving signal.

The light source compensator starts its operation in response to the enable signal, receiving the white light from the light source section, and outputting the compensation signal to compensate a light characteristic of the white light.

In another aspect of the present invention, a display apparatus includes a display unit that displays an image corresponding to an image signal from an exterior source using a white light, and a light generating device that is provided under the display unit to generate the white light.

The light generating device includes a brightness detector, a dimming signal controller, a light source driver, a light source section, and a light source compensator.

The brightness detector receives a plurality of image data from an exterior source and detects a plurality of brightness data corresponding to the image data. The brightness detector compares a plurality of gray scales corresponding to the image data with a reference gray scale and outputs an enable signal based on the compared result. The dimming signal controller receives a compensation signal and the brightness data. The dimming signal controller outputs a first dimming signal corresponding to the brightness data and a second dimming signal obtained by compensating the first dimming signal based on the compensation signal. The light source driver outputs a driving signal in response to either the first dimming signal or the second dimming signal from the dimming signal controller. The light source section includes a plurality of light sources that generates a white light in response to the driving signal. The light source compensator starts its operation in response to the enable signal, receiving the white light from the light source section, and outputting the compensation signal to compensate a light characteristic of the white light.

In another aspect of the present invention, a method of driving a light generating device having a plurality of light source units that generates a white light in response to a driving signal is provided as follows.

When an image data is received from an exterior source, a brightness data is extracted from the image data and a gray scale of the image data is compared with a reference gray scale. Based on the compared result, either a first dimming signal corresponding to the brightness data or a second dimming signal obtained by compensating the first dimming signal is output. Then, the driving signal corresponding to the first or second dimming signal is output, so that the white light is emitted from the light source units in response to the driving signal.

According to the above, the light generating device compensates the uniformity of the white light whenever the image data that is higher than the reference gray scale is input through the brightness detector.

BRIEF DESCRIPTION OF THE DRAWINGS

The above and other advantages of the present invention will become readily apparent by reference to the following detailed description when considered in conjunction with the accompanying drawings wherein.

DESCRIPTION OF THE EMBODIMENTS

Figure 1:
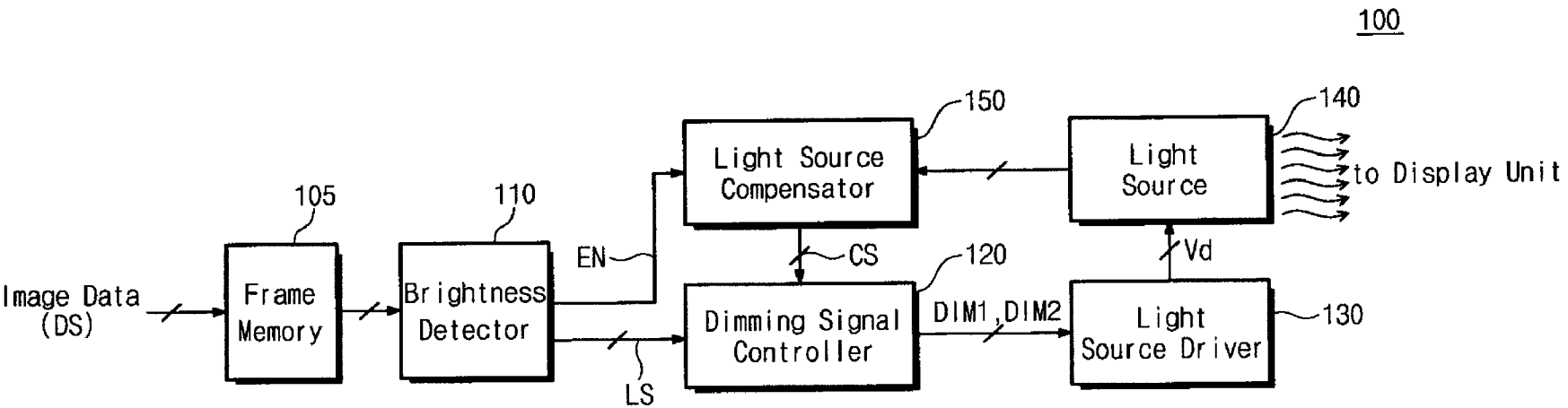
FIG. 1 is a block diagram showing an exemplary embodiment of a light generating device according to the present invention.

Hereinafter, the present invention will be explained in detail with reference to the accompanying drawings. In the drawings, the thickness of layers, films, and regions are exaggerated for clarity. Like numerals refer to like elements throughout. It will be understood that when an element such as a layer, film, region, or substrate is referred to as being "on" another element, it can be directly on the other element or intervening elements may also be present.

FIG. 1 is a block diagram showing an exemplary embodiment of a light generating device according to the present invention.

Referring to FIG. 1, a light generating device 100 includes a brightness detector 110 that generates brightness data LS detected from image data DS, a dimming signal controller 120 that outputs dimming signals (DIM1,DIM2) corresponding to the brightness data LS, a light source driver 130 that outputs a driving signal Vd corresponding to the dimming signals (DIM1, DIM2), a light source section 140 that emits a white light in response to the driving signal Vd, and a light source compensator 150 that compensates the white light emitted from the light source section 140. The light generating device 100 further includes a frame memory 105. The frame memory 105 stores the image data DS therein by a frame unit. The stored image data DS is provided to the brightness detector 110.

Figure 2:
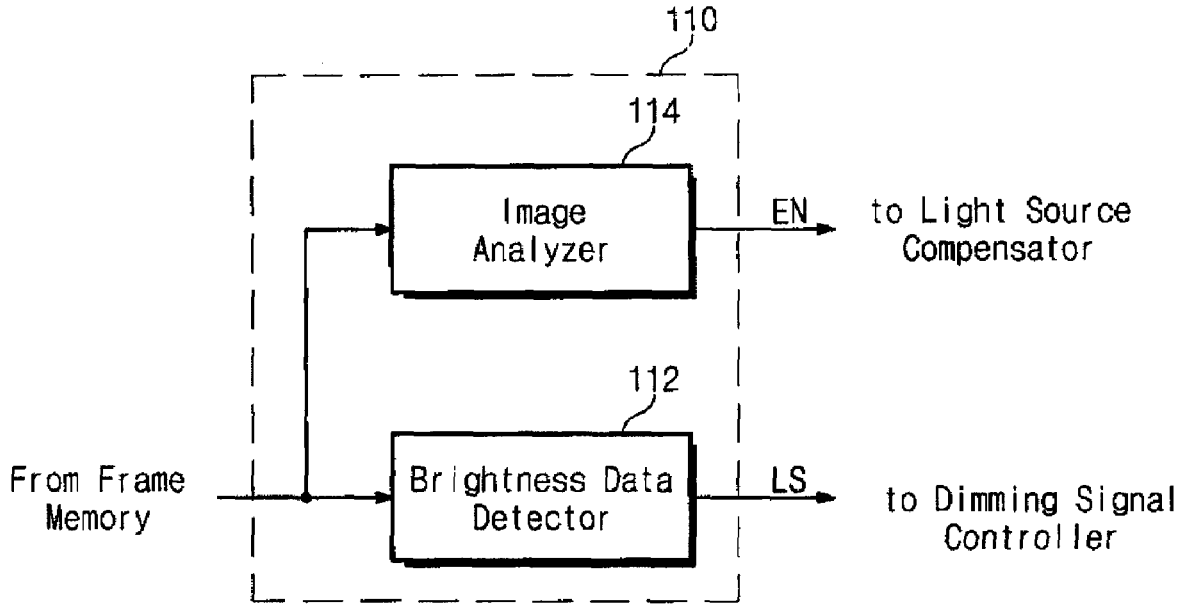
FIG. 2 is a block diagram showing a brightness detector of FIG. 1.

FIG. 2 is a block diagram showing a brightness detector of FIG. 1.

Referring to FIG. 2, the brightness detector 110 includes a brightness data detector 112 and an image analyzer 114.

The brightness data detector 112 receives the image data DS corresponding to one frame from the frame memory 105, and detects the brightness data LS from the image data DS.

The image data DS are digital data including red data R, green data G and blue data B. Thus, the brightness data LS detected from the image data DS includes red brightness data rLS, green brightness data gLS, and blue brightness data bLS.

In the present exemplary embodiment, Light Emitting Diodes (LEDs) corresponding to three colors of red, green and blue are used as light sources. Thus, the red brightness data rLS, the green brightness data gLS, and the blue brightness data bLS are used to adjust the light amount of the red, green and blue LEDs, respectively. The white light is formed by mixing the lights emitted from the red, green and blue LEDs. On the other hand, a white (monochrome) color LED may be used as the light source.

The image data DS does not include the brightness data LS. Therefore, the brightness data detector 112 converts the image data DS into color space data using a color space conversion algorithm, and detects the brightness data LS corresponding to the image data DS from the color space data.

The image analyzer 114 detects a plurality of gray scales from the image data DS and compares the gray scales with a predetermined reference gray scale. The image analyzer 114 outputs an enable signal EN when the gray scales are equal to or greater than the reference gray scale. The reference gray scale may be set in various values, preferably in a value corresponding to an intermediate value of the whole gray scale range. For instance, when the gray scales are 256, the reference gray scale is set to 127.

Referring to FIG. 1 again, the dimming signal controller 120 receives the brightness data LS from the brightness detector 110 and compensation data CS from the light source compensator 150. The dimming signal controller 120 outputs either a first dimming signal DIM1 corresponding to the brightness data LS or a second dimming signal DIM2 obtained by compensating the first dimming signal DIM1.

The first dimming signal DIM1 includes a first red dimming signal corresponding to the red brightness data rLS, a first blue dimming signal corresponding to the blue brightness data bLS, and a first green dimming signal corresponding to the green brightness data gLS. The second dimming signal DIM2 includes a second red dimming signal obtained by compensating the first red dimming signal, a second green dimming signal obtained by compensating the first green dimming signal, and a second blue dimming signal obtained by compensating the first blue dimming signal.

In the present exemplary embodiment, the dimming signal serves as a pulse-shaped signal to control the brightness of the white light emitted from the light source when performing a power saving mode or enhancing a contrast ratio (C/R).

The dimming signal controller 120 adjusts a duty ratio of the first and second dimming signals DIM1 and DIM2 to control the brightness of the white light. The duty ratio indicates a ratio of high period to one period of a pulse. That is, when one period of each of the first and second dimming signals DIM1 and DIM2 is defined as "T", the one period T is constituted by a high period during which the light source is turned on and a low period during which the light source is turned off. When the high and low periods of the one period T are defined as "t1" and "t2", respectively, the duty ratio of each of the first and second dimming signals DIM1 and DIM2 indicates a ratio of the high period t1 to the one period T Thus, the dimming signal controller 120 may adjust the high period t of the one period T of each of the first and second dimming signals DIM1 and DIM2, and the adjusting method of the first and second dimming signals DIM1 and DIM2 is known as a pulse width modulation PWM. As the duty ratio of the first and second dimming signals DIM1 and DIM2 increases, the brightness of the white light increases.

The duty ratio is previously set in accordance with the gray scales of the image data DS with respect to each gray scale level. Thus, when the brightness data LS corresponding to zero gray scale is input to the dimming signal controller 120, the dimming signal controller 120 outputs the first and second dimming signals DIM1 and DIM2 each having a minimum duty ratio. Also, when the brightness data LS corresponding to 256 gray scale is input to the dimming signal controller 120, the dimming signal controller 120 outputs the first and second dimming signals DIM1 and DIM2 each having a maximum duty ratio.

In the present exemplary embodiment, the duty ratio is not previously set with respect to all gray scale levels. In other words, the duty ratio corresponding to only the gray scale for lower gray than the reference gray scale among the gray scales is previously set, and the duty ratio corresponding to the remaining gray scales is set to have the maximum duty ratio. Thus, the white light emitted from the light source section 140 is maintained in the maximum brightness in case that the gray scales are higher than the reference gray scale.

The light source driver 130 outputs a driving voltage Vd corresponding to either the first dimming signal DIM1 or the second dimming signal DIM2 output from the dimming signal controller 120. The driving voltage Vd includes a red driving voltage, a green driving voltage, and a blue driving voltage.

The light source section 140 includes a plurality of light sources that emits the white light corresponding to the driving voltage Vd. Each of the light sources includes a red light emitting diode, a green light emitting diode, and a blue light emitting diode. The red, green and blue LEDs output a red light, a green light, and a blue light corresponding to the red, green and blue driving voltages, respectively. When the red, green and blue driving voltages are mixed with each other, the white light is emitted from the light source section 140. The light sources are classified into plural groups, and each group is independently operated.

The light compensator 150 starts its operation in response to the enable signal EN from the image analyzer 114. The light compensator 150 receives the white light emitted from the light source section 140 and outputs the compensation data CS to compensate the light characteristics of the white light.

Figure 3:
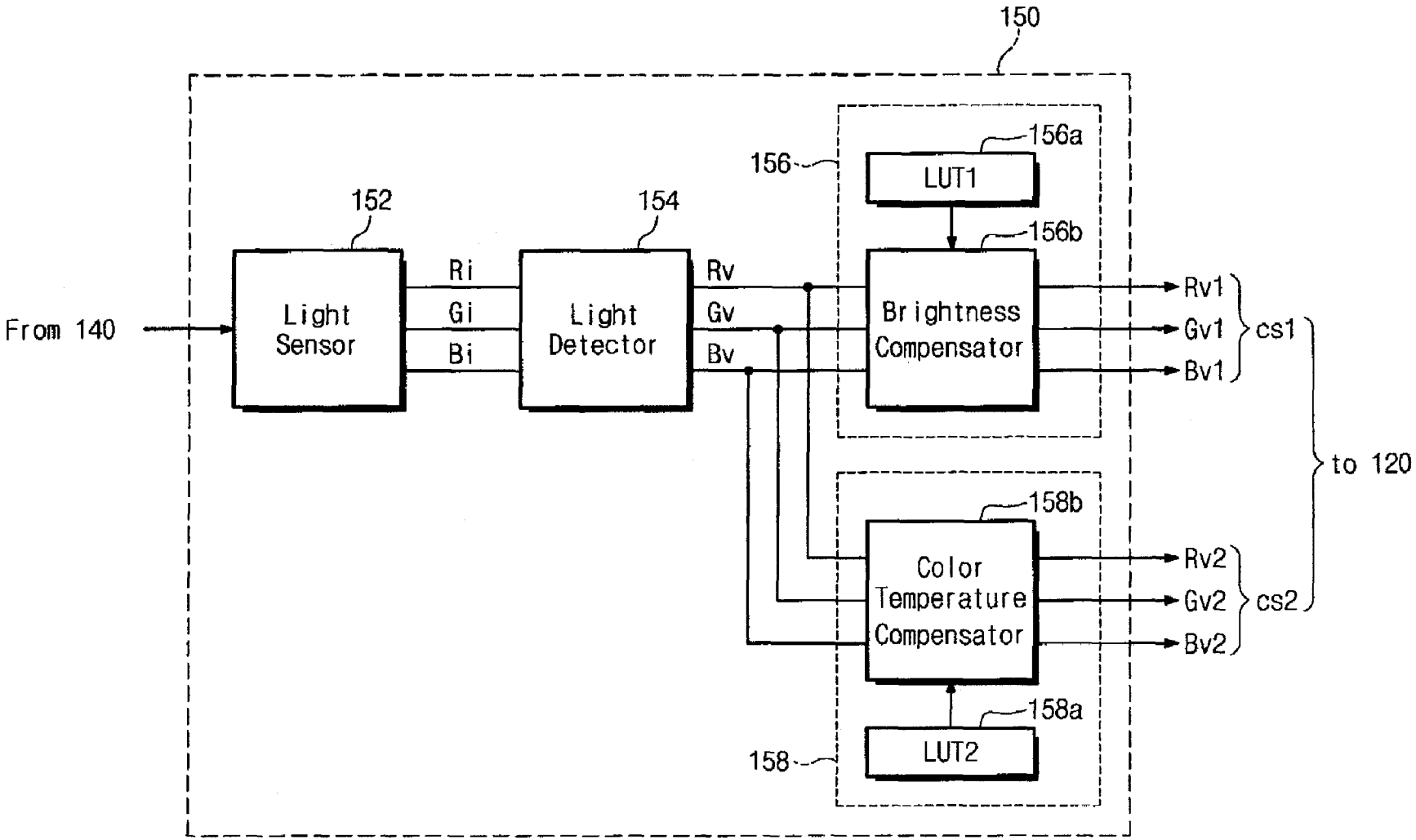
FIG. 3 is a block diagram showing a light source compensator of FIG. 1

FIG. 3 is a block diagram showing a light source compensator of FIG. 1.

Referring to FIG. 3, the light compensator 150 includes a light sensor 152, a light detector 154, a first compensator 156, and a second compensator 158. The light sensor 152 includes at least one light sensor to sense a light amount of the white light emitted from the light sources.

The light sensor 152 outputs current values Ri, Gi and Bi corresponding to the red light, the green light, and the blue light of the white light, respectively.

The light detector 154 converts the current values Ri, Gi and Bi into voltage values Rv, Gv and Bv, respectively. This is because the voltage values Rv, Gv and Bv are easily controlled compared with the current values Ri, Gi and Bi. Hereinafter, the voltage values Rv, Gv and Bv are referred to as a light detecting signal.

The first compensator 156 receives the light detecting signal Rv, Gv and Bv, compares a brightness of the light detecting signal RV, Gv and Bv with a predetermined target brightness, and outputs a first compensation data Rv1, Gv1 and Bv1 (hereinafter, referred to as CS1) based on the compared result.

The first compensator 156 includes a first memory 156*a* and a brightness compensator 156*b*. The first memory 156*a* stores the target brightness value as a lookup table therein. The brightness compensator 156*b* compares the target brightness value with the brightness value corresponding to the light detecting signal Rv, Gv and Bv, and outputs the first compensation data CS1 based on the compared result. The first compensation data CS1 is applied to the dimming signal controller 120.

The second compensator 158 receives the light detecting signal Rv, Gv and Bv, compares a color temperature value corresponding to the light detecting signal Rv, Gv and Bv with a predetermined target color temperature value, and outputs a second compensation data Rv2, Gv2 and Bv2 (hereinafter, referred to as CS2) based on the compared result.

In particular, the second compensator 158 includes a second memory 158*a* and a color temperature compensator 158*b*. The second memory 158*a* stores the target color temperature value as a lookup table therein. Also, the second memory 158*a* may store the target color temperature value as a target X-coordinates value and a target Y-coordinates value corresponding to International Commission on Illumination or Commission Internationale de l'Eclairage(CIE) coordinates.

The color temperature compensator 158*b* reads out the target color temperature value, compares the target color temperature value with a color temperature value of the light detecting signal Rv, Gv and Bv, and outputs the second compensation data CS2 based on the compared result.

Figure 4:
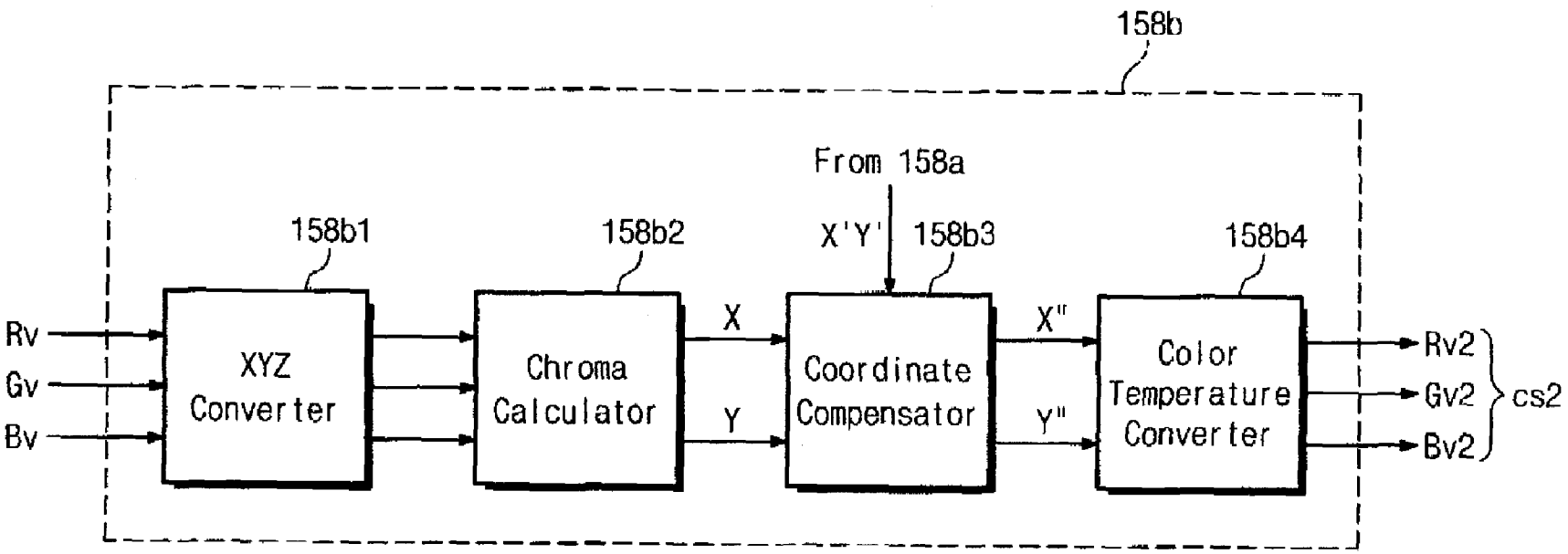
FIG. 4 is a block diagram showing a color temperature compensator of FIG. 3.

FIG. 4 is a block diagram showing a color temperature compensator of FIG. 3.

Referring to FIG. 4, the color temperature compensator 158*b* includes an XYZ converter 158*b*1, a chroma calculator 158*b*2, a coordinate compensator 158*b*3, a color temperature converter 158*b*4.

The XYZ converter 158*b*1 receives the light detecting signal Rv, Gv and Bv and converts the light detecting signal Rv, Gv and Bv into XYZ values of the CIE coordinates.

The chroma calculator 158*b*2 receives the XYZ values, calculates a primary X-coordinate (X) based on distribution of the color temperature value corresponding to a white region of the CIE coordinates, and calculates a primary Y-coordinate (Y) based on the primary X-coordinate (X).

The coordinate compensator 158*b*3 reads out a target X-coordinate (X') and a target Y-coordinate (Y') of the CIE coordinates corresponding to the color temperature value stored in the second memory 158*a*, and compares the target X-coordinate (X') and the target Y-coordinate (Y') with the primary X-coordinate (X) and the primary Y-coordinate (Y), respectively. Based on the compared result, the coordinate compensator 158*b*3 outputs a compensated X-coordinate (X") and a compensated Y-coordinate (Y").

More specifically, the coordinate compensator 158*b*3 calculates an X-coordinate difference value between the primary X-coordinate (X) and the target X-coordinate (X') and a Y-coordinate difference value between the primary Y-coordinate (Y) and the target Y-coordinate (Y'). The coordinate compensator 158*b*3 outputs the compensated X-coordinate (X") and the compensated Y-coordinate (Y") based on the X-coordinate difference value and the Y-coordinate difference value.

The color temperature converter 158*b*4 outputs a compensated color temperature value based on the compensated X-coordinate (X") and the compensated Y-coordinate (Y"), and outputs the second compensation data CS2 corresponding to the compensated color temperature value. The second compensation data CS2 is applied to the dimming signal controller 120.

The dimming signal controller 120 receives the brightness data LS from the brightness detector 110 to output the first dimming signal DIM1 and the second dimming signal DIM2 based on the compensation signal CS from the light source compensator 150. The dimming signal controller 120 further includes a memory in which the first and second compensation data CS1 and CS2 are stored as the reference data used to control the dimming signals.

Figure 5:
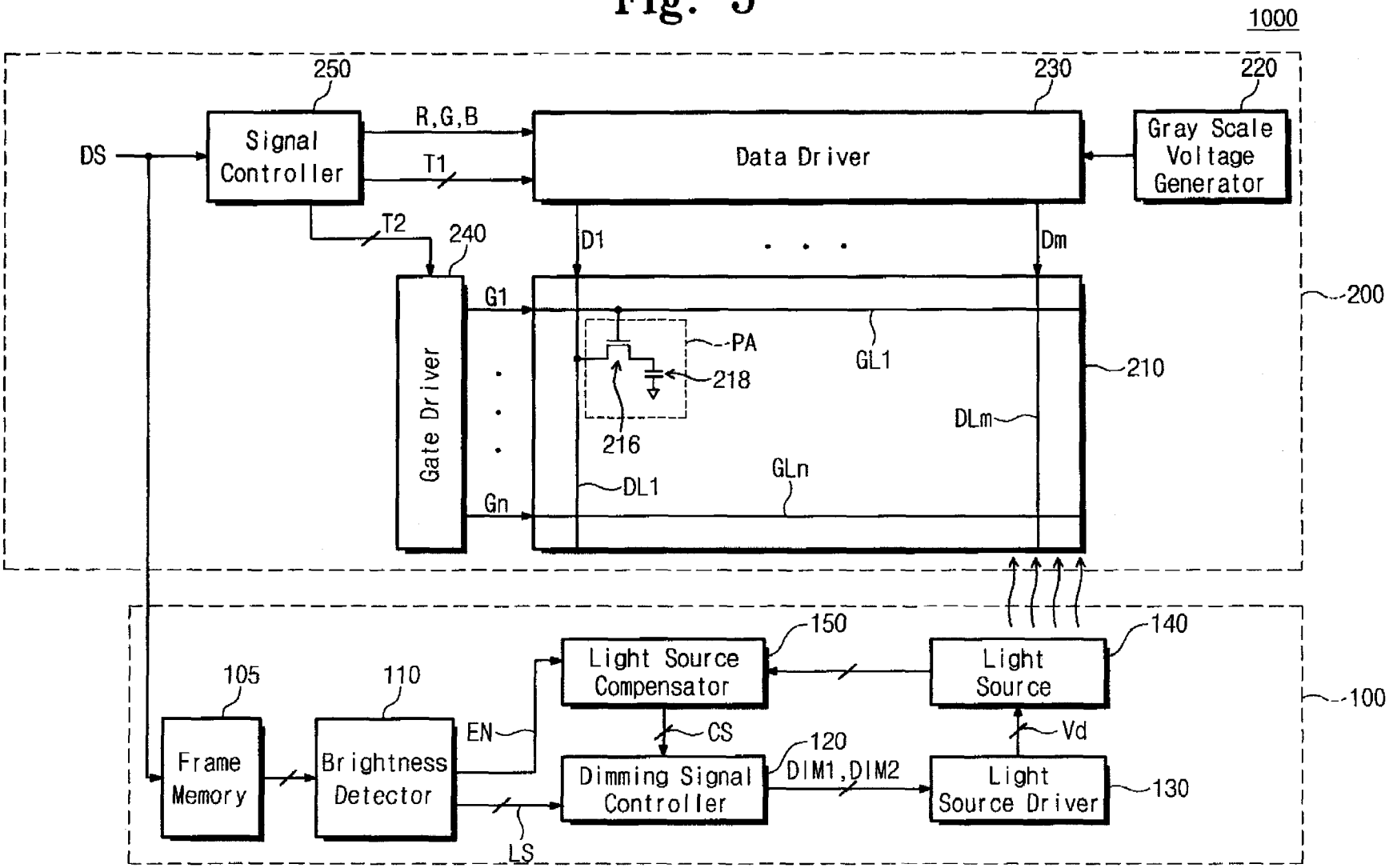
FIG. 5 is a block diagram showing a display apparatus employing the light generating device of FIG. 1.

FIG. 5 is a block diagram showing a display apparatus employing the light generating device of FIG. 1. In FIG. 5, the same reference numerals denote the same elements in FIG. 1, and thus the detailed descriptions of the same elements will be omitted.

Referring to FIG. 5, a display apparatus 1000 includes a display unit 200 and a light generating device 100.

The display unit 200 includes a liquid crystal display panel 210, a gray scale voltage generator 220, a data driver 230, a gate driver 240, and a signal controller 250.

The liquid crystal display panel 210 displays images in response to second data signals D1, . . . , Dm corresponding to first data signals R, G and B provided from the signal controller 250.

The liquid crystal display panel 210 includes first to n-th gate lines GL1, . . . , GLn and first to m-th data lines DL1, . . . , DLm crossing the first to n-th gate lines GL1, . . . , GLn. The liquid crystal display panel 210 includes a plurality of pixel areas defined by the first to n-th gate lines GL1, . . . , GLn and the first to m-th data lines DL1, . . . , DLm. In the present exemplary embodiment, the pixel areas have a same configuration, and thus a first pixel area PA defined by two adjacent gate lines and two adjacent data lines will be described as a representative pixel area.

In the first pixel area PA, a thin film transistor 216 connected to a first gate line GL1 and a first data line DL1 and a liquid crystal capacitor 218 connected to the thin film transistor 216 are formed.

The gray scale voltage generator 220 generates a plurality of gray scale voltages corresponding to image signals from an exterior source, and provides the gray scale voltages to the data driver 230.

The data driver 230 generates the gray scale voltages corresponding to the first data signal R, G and B as the second data signals D1, . . . , Dm having analog voltage levels. Then, the data driver 230 outputs the second data signals D1, . . . , Dm to the first to m-th data lines DL1, . . . , DLm in response to a first timing signal T1, respectively.

The gate driver 240 sequentially outputs gate driving signals G1, . . . , Gn to the first to n-th gate lines GL1, . . . , GLn, respectively, in response to a second timing signal T2. Thin film transistors arranged in the pixel areas, respectively, are turned on or off in response to the gate driving signals G1, . . . , Gn to provide the second data signals D1, . . . , Dm to the liquid crystal capacitors, respectively, through the thin film transistors.

The signal controller 250 generates the first data signals R, G and B, the first timing signal T1, and the second timing signal T2 in response to the image signal DS having a digital signal format. In the present exemplary embodiment, the first data signals R, G and B have the digital signal format. In addition, the signal controller 250 includes a frame memory, and stores the first data signals R, G and B in the frame memory in one frame unit. The first data signals R, G and B stored in the frame memory are applied to the brightness detector 110.

The first timing signal T1 includes an output indicating signal that represents the output of the second data signals D1, . . . , Dm to the liquid crystal display panel 210 and a line inversion signal that inverts the polarity of the data voltage corresponding to the second data signals D1, . . . , Dm.

The second timing signal T2 includes a gate clock signal that decides periods of the gate driving signals G1, . . . , Gn applied to the first to n-th gate lines GL1, . . . , GLn, a vertical start signal STV that starts the gate driving signals G1, . . . , Gn, and an output enable signal that enables the output of the gate driver 240.

In FIG. 5, the brightness detector 110 receives the image data DS through the frame memory 105, however the brightness detector 110 may directly receive the image data DS from the signal controller 250. In this case, the frame memory 105 shown in FIG. 5 may be replaced by a frame memory arranged inside the signal controller 250.

Further, in the present exemplary embodiment, the brightness detector 110 is separated from the signal controller 250, but the brightness detector 110 may be arranged inside the signal controller 250.

Figure 6:
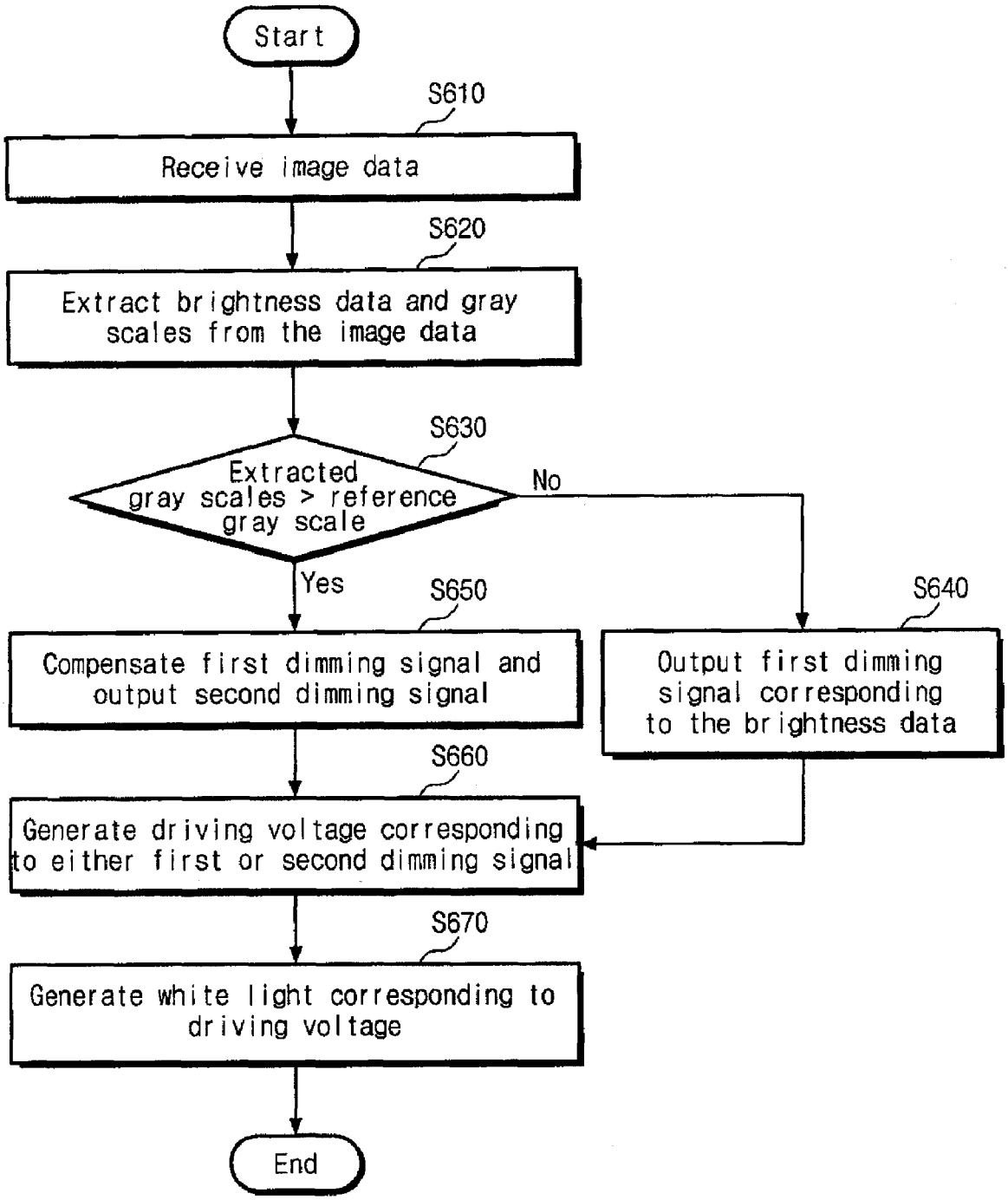
FIG. 6 is a flow chart illustrating a method of driving the light generating device of FIG. 1.

FIG. 6 is a flow chart illustrating a method of driving the light generating device of FIG. 1.

Referring to FIG. 6, a plurality of image data is received from an exterior source (S610).

Then, a plurality of brightness data is extracted from the image data, and a plurality of gray scales corresponding to the image data is extracted in order to analyze an image pattern of the image data (S620).

The gray scales are compared with a predetermined reference gray scale, so that the image pattern of the image data is analyzed. Particularly, when the gray scales are greater than the reference gray scale, the image pattern is analyzed as a full white pattern (S630). On the contrary, when at least one of the gray scales is smaller than the reference gray scale, the image pattern is not the same as the full white pattern.

In case that the image pattern is not the same as the full white pattern, the first dimming signal DIM1 corresponding to the brightness data is output (S640). In case that the image pattern is the same as the full white pattern, the second dimming signal DIM2 obtained by compensating the first dimming signal DIM1 corresponding to the brightness data is output (S650).

Then, the driving voltage corresponding to either the first dimming signal DIM1 or the second dimming signal DIM2 is generated (S660), and the white light corresponding to the driving voltage is generated (S670).

According to the above, the light generating device compensates the uniformity of the white light whenever the image data that is higher than the reference gray scale is input through the brightness detector.

That is, the light generating device compensates the uniformity of the white light in real time to improve the uniformity of the white light.

Thus, the display apparatus adopting the light generating device may increase the display quality of the image.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A light generating device comprising:

a brightness detector receiving a plurality of image data from an exterior source, detecting a plurality of brightness data corresponding to the image data, comparing a plurality of gray scales corresponding to the image data with a reference gray scale, and outputting an enable signal based on the compared result;

a dimming signal controller receiving a compensation signal and the brightness data and outputting a first dimming signal corresponding to the brightness data and a second dimming signal obtained by compensating the first dimming signal based on the compensation signal;

a light source driver outputting a driving signal in response to either the first dimming signal or the second dimming signal from the dimming signal controller;

a light source section comprising a plurality of light sources that generates a white light in response to the driving signal; and a light source compensator starting its operation in response to the enable signal, receiving the white light from the light source section, and outputting the compensation signal to compensate a light characteristic of the white light.

2. The light generating device of claim 1, further comprising a frame memory that stores the image data corresponding to at least one frame and provides the stored image data to the brightness detector.

3. The light generating device of claim 1, wherein the light characteristic of the white light is a brightness value.

4. The light generating device of claim 1, wherein the light characteristic of the white light is a color temperature value.

5. The light generating device of claim 1, wherein the reference gray scale has a gray scale level corresponding to about ½ of a whole gray scale range.

6. The light generating device of claim 5, wherein the dimming signal controller outputs the second dimming signal having a predetermined maximum duty ratio when the gray scales corresponding to the image data are higher than the reference gray scale.

7. The light generating device of claim 1, wherein the brightness detector comprises:

an image analyzer receiving the image data and outputting the enable signal when the gray scales corresponding to the image data are greater than the reference gray scale; and a brightness data detector detecting the brightness data from the image data.

8. The light generating device of claim 1, wherein each of the light sources comprises a red light emitting diode, a green light emitting diode, and a blue light emitting diode.

9. The light generating device of claim 1, wherein the compensation signal comprises a first compensation data and a second compensation data, and the light source compensator comprises:

a light sensor sensing a light amount of the white light;

a light detector outputting a light detecting signal corresponding to the light amount;

a first compensator receiving the light detecting signal, comparing a brightness value of the light detecting signal with a predetermined target brightness value, and outputting the first compensation data based on the compared result; and a second compensator receiving the light detecting signal, comparing a color temperature value of the light detecting signal with a predetermined target color temperature value, and outputting the second compensation data based on the compared result.

10. The light generating device of claim 9, wherein the first compensator comprises:

a first memory storing the target brightness value therein; and a brightness compensator reading out the target brightness value, calculating a difference value between the target brightness value and the brightness value of the light detecting signal, and compensating the brightness value of the light detecting signal based on the difference value to output the first compensation data, and the second compensator comprises:

a second memory storing the target color temperature value therein; and a color temperature compensator reading out the target color temperature value, calculating a difference value between the target color temperature value and the color temperature value of the light detecting signal, and compensating the color temperature value of the light detecting signal base on the difference value to output the second compensation data.

11. The light generating device of claim 10, wherein the color temperature compensator comprises:

an XYZ converter receiving the light detecting signal and converting the light detecting signal into an XYZ value of a CIE coordinate;

a chroma calculator calculating a primary X-coordinate of the light detecting signal based on a distribution of a color temperature value of the CIE coordinate and calculating a primary Y-coordinate base on the primary X-coordinate;

a coordinate compensator reading out the target color temperature value from the second memory, calculating a target X-coordinate and a target Y-coordinate corresponding to the target color temperature value, calculating an X-coordinate difference value between the target X-coordinate and the primary X-coordinate and an Y-coordinate difference value between the target Y-coordinate and the primary Y-coordinate, and compensating the primary X-coordinate and the primary Y-coordinate based on the X-coordinate difference value and the Y-coordinate difference value to output a compensated X-coordinate and a compensated Y-coordinate; and a color temperature converter compensating the color temperature value of the light detecting signal based on the compensated X-coordinate and the compensated Y-coordinate, and outputting the second compensation data corresponding to the compensated color temperature value.

12. A display apparatus comprising:

a display unit displaying an image corresponding to an image signal from an exterior source using a white light; and a light generating device provided under the display unit to generate the white light, the light generating device comprising:

a brightness detector receiving a plurality of image data from an exterior source, detecting a plurality of brightness data corresponding to the image data, comparing a plurality of gray scales corresponding to the image data with a reference gray scale, and outputting an enable signal based on the compared result;

a dimming signal controller receiving a compensation signal and the brightness data and outputting a first dimming signal corresponding to the brightness data and a second dimming signal obtained by compensating the first dimming signal based on the compensation signal;

a light source driver outputting a driving signal in response to either the first dimming signal or the second dimming signal from the dimming signal controller;

a light source section comprising a plurality of light sources that generates a white light in response to the driving signal; and a light source compensator starting its operation in response to the enable signal, receiving the white light from the light source section, and outputting the compensation signal to compensate a light characteristic of the white light.

13. The display apparatus of claim 12, wherein each of the light sources comprises a red light emitting diode, a green light emitting diode, and a blue light emitting diode.

14. The display apparatus of claim 12, wherein the brightness detector comprises:

an image analyzer receiving the image data and outputting the enable signal when the gray scales corresponding to the image data are greater than the reference gray scale; and a brightness data detector detecting the brightness data from the image data.

15. The display apparatus of claim 12, wherein the light characteristic of the white light is a brightness value.

16. The display apparatus of claim 12, wherein the light characteristic of the white light is a color temperature value.

17. The display apparatus of claim 12, wherein the reference gray scale has a gray scale level corresponding to about ½ of a whole gray scale range.

18. The display apparatus of claim 17, wherein the dimming signal controller outputs the second dimming signal having a predetermined maximum duty ratio when the gray scales corresponding to the image data are higher than the reference gray scale.

19. A method of driving a light generating device having a plurality of light source units that generates a white light in response to a driving signal, the method comprising:

receiving an image data from an exterior source;

extracting a brightness data from the image data and comparing a gray scale of the image data with a reference gray scale;

outputting either a first dimming signal corresponding to the brightness data or a second dimming signal obtained by compensating the first dimming signal based on the compared result;

generating the driving signal corresponding to the first or second dimming signal; and emitting the white light from the light source units in response to the driving signal.

20. The light generating device of claim 9, wherein the light sensor generates the light detection signal having current value and the light detector generates the light detection signal having voltage value.

* * * * *